United States Patent [19]

Limeres et al.

[11] 4,001,747

[45] Jan. 4, 1977

[54] FLASHER SWITCH VANE STRUCTURE

[75] Inventors: Ricardo Limeres, Staten Island; Alfred Osborn, Lindenhurst, both of N.Y.

[73] Assignee: Ideal Corporation, Brooklyn, N.Y.

[22] Filed: June 23, 1975

[21] Appl. No.: 589,708

[52] U.S. Cl. ..... 337/136; 337/391

[51] Int. Cl.[2] ..... H01H 61/00; H01H 71/18

[58] Field of Search ..... 337/135, 136, 131, 137, 337/390, 391, 396

[56] References Cited

UNITED STATES PATENTS

| | | | |
|---|---|---|---|
| 3,518,598 | 6/1970 | Jakobs | 337/135 |
| 3,711,808 | 1/1973 | Kamiyama et al. | 337/135 |

*Primary Examiner*—George Harris
*Attorney, Agent, or Firm*—Albert C. Johnston; Gerard F. Dunne

[57] ABSTRACT

An improved self-biased vane structure normally buckled to an abnormal posture by a thermally expansible pull member comprises a piece of resilient sheet metal deformed downwardly relative to a horizontal reference plane between pairs of divergent creases which extend to opposite lateral edges of the piece from respective apex points spaced apart on the longitudinal center line thereof. The vane thus has a pair of triangular end panels between which there are oppositely sloped side or wing panels, and has a transversely, elastically bowed portion between the apex points. The bowed central portion may be creased longitudinally and/or formed with a central opening to give it selected buckling properties. The pull member extends centrally from end to end over the convex side of the vane; when it is heated, as by an electric current passing through it and the vane, the vane snaps toward its natural posture and brings the pull member into cooling contact with its central portion and its end panels.

6 Claims, 6 Drawing Figures

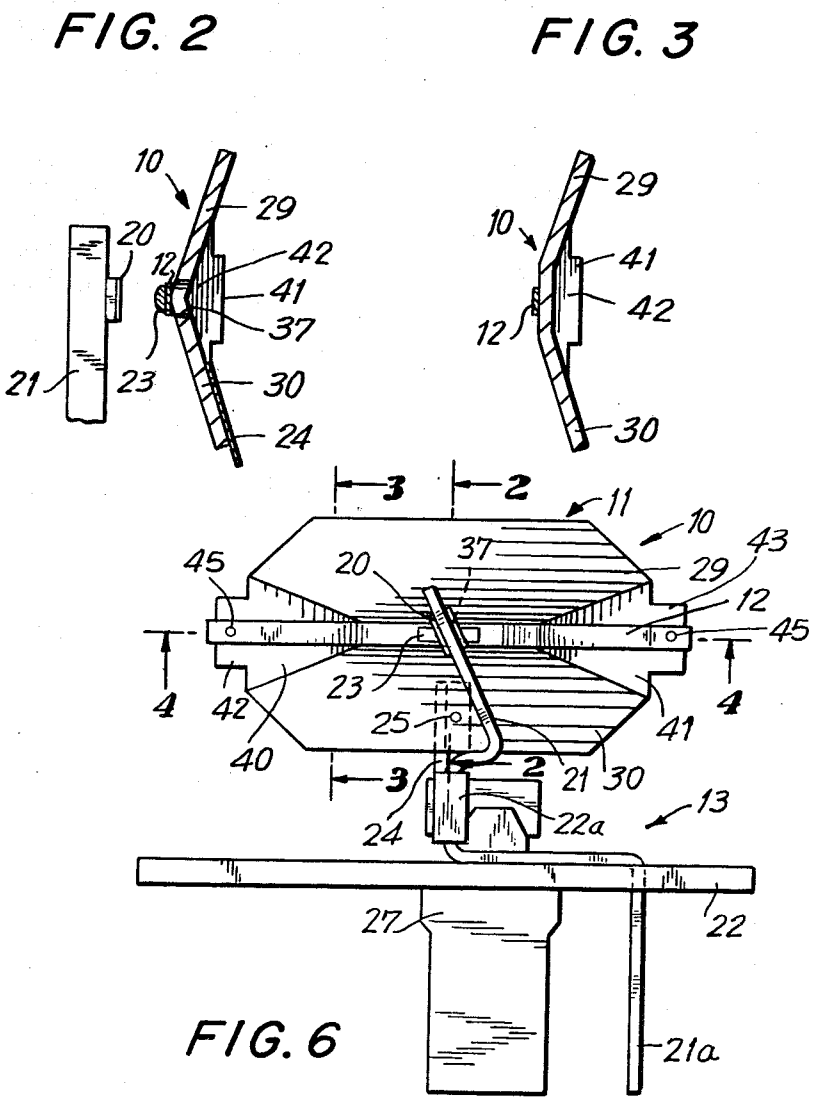
FIG. 3
FIG. 2
FIG. 6
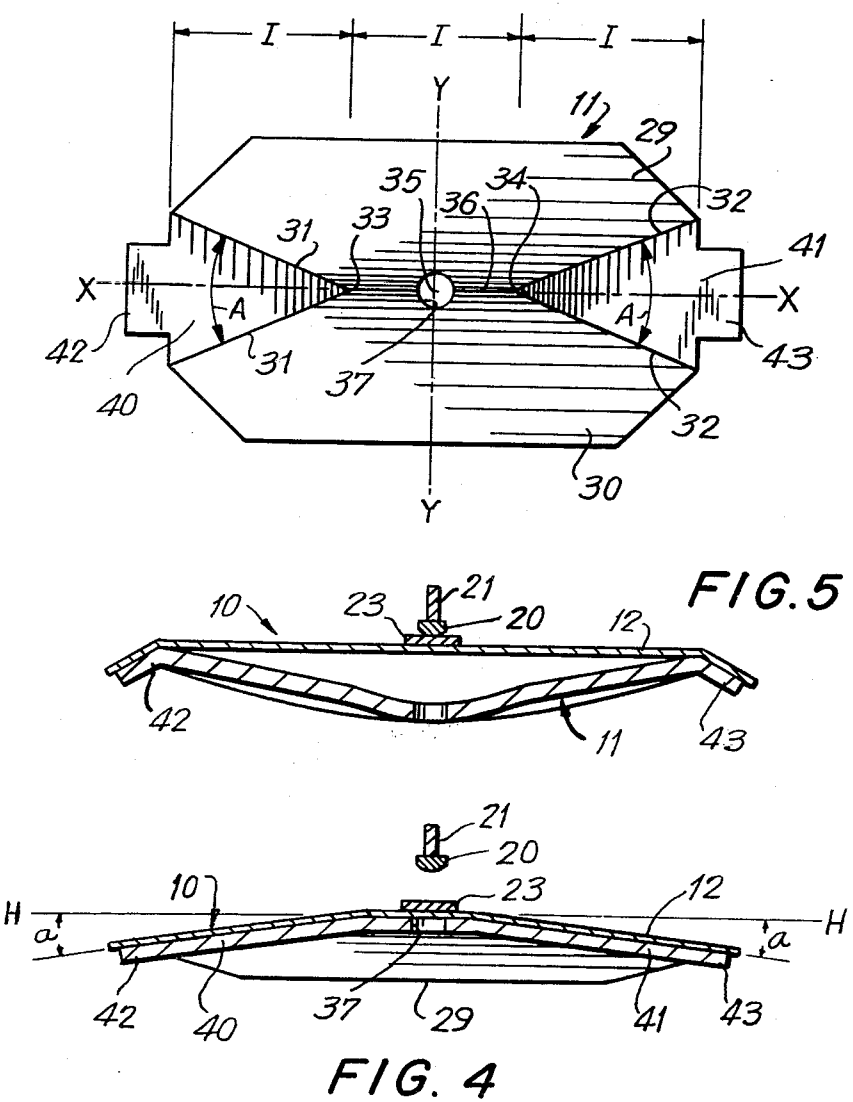
FIG. 1
FIG. 5
FIG. 4

FLASHER SWITCH VANE STRUCTURE

Snap action switches of the type in which an electrical circuit is interrupted at regular short intervals by a moving contact controlled by a resilient vane which is buckled or otherwise flexed between "make" and "break" positions under the influence of a thermally expansible pull member are well known and have found widespread applications in flasher switches used for controlling automobile hazard warning lamps, turn signal lamps, and the like. The present invention is directed to an improved vane and expansible pull member subassembly for such switches, which subassembly has improved snapping characteristics, improved stiffness and durability, and lends itself to inexpensive and simple manufacturing techniques.

The advantageous features and improved operating characteristics of the new vane and pull member subassembly are derived from its special configuration. More specifically, the new vane has a shallow dished shape established by two pairs of divergent creases extending to the lateral edges of the vane from spaced points on the longitudinal axis of the vane. By varying the spacing of the pairs of divergent creases and the angle of divergence of the creases, the snapping characteristics of the vane may be precisely determined. Moreover, the characteristics of the vane may be enhanced by the inclusion of an additional longitudinal crease extending between the pairs of diverging creases and/or by the inclusion of a stress relieving opening in the center of the vane.

For a more complete understanding of the principles of the present invention and for a further appreciation of its attendant advantages, reference should be made to the following detailed description of the invention, taken in conjunction with the accompanying drawings, in which:

FIG. 1 is a plan view of a new and improved vane embodying the principles of the invention;

FIGS. 2, 3 and 4 are cross-sectional views of a new vane subassembly incorporated into a flasher switch assembly shown in FIG. 6 and taken along lines 2—2, 3—3, and 4—4, respectively, thereof;

FIG. 5 is a longitudinal, cross-sectional view of the new vane-pull member subassembly with the vane tensioned into an unnatural posture; and FIG. 6 is a front elevational view of a flasher switch assembly incorporating the new vane-pull member subassembly.

Referring now to FIG. 1, a new and improved vane 11 is formed from an elongated flat sheet of resilient conductive material such as spring steel or beryllium copper and has a longitudinal median axis XX and a lateral median axis YY. Advantageously, the vane 11 is symmetrical about its lateral and longitudinal axes and is generally octagonal in shape.

In accordance with the principles of the invention, the vane 11 is provided with an intrinsic bias and "natural posture" (shown generally in FIG. 4) by crimping or otherwise deforming the flat sheet material downwardly from the horizontal HH along pairs of diverging creases lines 31, 32, which extend from apex points 33, 34 spaced apart on the longitudinal axis and equidistant from the center 35 of the vane. Opposite end portions or panels 40, 41 are defined within the respective included angles A of the crease pairs 31, 32. Advantageously, an additional, centrally formed crease 36 extends coincident with the longitudinal axis between points 33, 34. Lying at opposite sides of the axis XX and along the longitudinal edges of the vane between the pairs of creases 31, 32 are wing panels 29, 30. As shown, the end panels 40, 41 have rectangular protrusions forming attachment tabs 42, 43. Additionally, a circular stress relieving opening 37 is formed at the center 35 of the vane. Importantly, the divergent creases 31, 32 provide the outer regions I, III (FIG. 1) of the vane with substantially flat panels or platform portions having stiffness while forming between these portions an elastically bowed central portion II (FIG. 1).

More specifically, the resilient sheet material of the vane 11 is deformed from a flat, horizontal plane HH into a dished "natural posture" (FIG. 4) having an intrinsic bias by crimping the same along creases 31, 32 to form the end panels 40, 41 in planes disposed at acute angles *a* of depression from the horizontal and thereby simultaneously forming a transversely bowed central portion in region II along the common middle area of the wing panels 29, 30. The panels 29, 30 are thus curved transversely between the points 33 and 34 into a generally arcuate or cylindrical cross-section which may, if desired for increased stiffness, be creased to a limited extent along line 36 so as to have a somewhat peaked configuration as indicated in FIG. 2. The main body portions of panels 29, 30 are generally flat in the longitudinal direction (FIGS. 2 and 4). The extent of the downward bowing or dishing of the vane can be selected for a given material by choice of the size of the angles A and/or of the distance between their apex points.

Accordingly, the invention enables the snapping or buckling characteristics of the vane 11 to be modified, as may be desired to achieve optimum performance in a particular switching application, by variation of one or more of several vane parameters including: the angle of divergence A of the crease pairs 31, 32; the spacing of the bias points 33, 34; the extent of creasing, if any, along line 36; the extent of stress relief, if any, provided at the center of the vane by an opening such as opening 37.

As illustrated in FIGS. 4 and 5, a new and improved snap action switch subassembly 10 is obtained by anchoring a thermally expansible pull member 12, as by fasteners or welds 45, to the protruding end tabs 42, 43, with the pull member so dimensioned that it normally will hold the vane 11 bucked away from its natural posture, such as that shown in FIG. 4, into an abnormal or unnatural posture, such as that illustrated in FIG. 5.

The pull member 12 preferably is a thin, narrow, ribbon-like band or wire of an electrical resistance alloy, such, for example, as a flat chromium nickel alloy wire of the type known as "Nichrome", having a high electrical resistance and a high coefficient of thermal expansion. As will be understood, upon heating of the pull member 12, such as by passing a suitable electrical current through it, it will expand until it attains a "hot" condition in which it is sufficiently relaxed that the inherent resiliency and intrinsic bias of the vane 11 will overcome any remaining tension of the pull member and return the vane by a snapping action towards its natural posture indicated in FIG. 4.

Upon returning to the natural posture of FIG. 4, the vane brings the pull member 12 into intimate face-to-face contact with the end panels 40, 41, as well as with the central portion of the vane between points 33 and 34, so that the pull member then cools immediately by heat conduction into the vane. The end panels act as heat sinks, providing a fast and controllable rate of heat transfer from the pull member 12. Upon cooling sufficiently, the pull member 12 contracts and regains enough of its normal shortness and tension to overcome the intrinsic bias of the vane 11, whereupon it buckles the vane 11 once again into the unnatural posture indicated in FIG. 5. Thus, a cyclical heating and cooling of the pull member occurs with attendant snapping of the switch subassembly 10 alternately between the unnatural posture of FIG. 5 and the natural posture of FIG. 4 until the current supply is discontinued.

The new and improved switch subassembly 10 may be employed to advantage in a variety of applications. In a particularly advantageous use, it constitutes the principal component of an automobile flasher switch such, for example, as that illustrated at 3 in FIG. 6 and described herein by way of example only. The subassembly 10 may be employed as desired in a circuit for either series or parallel energization of the lamps or other devices controlled thereby.

As shown in FIG. 6 the subassembly 10 comprising the vane 11 and the expansible pull member 12 is employed in a snap action flasher switch 13 of a "fixed load" type suitable for flashing automobile turn signal lamps. This switch generally comprises a fixed electrical contact 20 joined to the free end of an upstanding conductor 21 which extends through an insulating block 22*a* and an insulating mounting plate 22 to a terminal 21*a* and a movable electrical contact 23 mounted and carried on a central portion of the pull member 12. The vane 11 is mounted in cantilever fashion on an upstanding arm 24 of a conductor assembly that extends through the mounting plate 22 to a terminal 27. As shown, a weld or other suitable fastener 25 joins a midpoint of the lower wing panel 30 of the vane 11 with the arm 24. The vane is held in a position relative to the contact 20 on arm 21 such that, when the vane is in its buckled or unnatural posture with the pull member 12 in "cold" condition, it holds the movable contact 23 pressed firmly against the fixed contact 20, while when the vane snaps toward its natural posture it moves the pull member and contact 23 thereon away from the fixed contact to break an electrical circuit it established between terminals 21*a* and 27.

Thus, the contacts 20, 23 will regularly and uniformly break and re-establish electrical continuity between the conductors upon the heating and cooling of the pull member 12. Buckling of the vane 11 into an unnatural posture is effected and the contacts 20, 23 are closed when the pull member 12 is cold and contracted sufficiently to overcome the intrinsic bias of the vane 11. Closing of the contacts 20, 23 allows current to flow through the pull member 12 to heat and to expand it. This, in turn, relaxes the applied tension and accommodates the return of the vane 11 towards its natural posture, thereby opening the contacts 20, 23 and causing the cooling of the pull member 12. The cycling of the vane 11 continues indefinitely until the pull member 12 in the cold position of FIG. 5 is no longer heated by current flow, as will be understood.

It will be appreciated that in accordance with the principles of the present invention, the subassembly of the vane 11 and the pull member 12 provides reliable and uniform snapping action along with improved durability and ease of selection of the desired operating characteristics, and lends itself, also, to simplified and economical manufacture by mass production techniques.

The embodiment of the invention herein illustrated and described is intended to be representative only, as it will be obvious changes may be made therein without departing from the teachings of the disclosure. Accordingly, reference should be made to the appended claims in determining the full scope of the invention.

What is claimed:

1. A switch subassembly comprising a piece of resilient sheet metal deformed from a flat horizontal reference plane into a vane intrinsically biased to a predetermined natural posture, said vane having formed therein pairs of divergent creases which extend oppositely respectively from points spaced apart on the longitudinal axis of the vane to opposite lateral edges thereof and define between the creases of each pair an end panel normally sloped away from said plane at an acute angle thereto; said vane having between said pairs of creases wing panels which slope oppositely away from said plane at the opposite sides of said axis, and having between the said points an elastically transversely bowed central portion; a thermally expansible pull member extending centrally along said vane and having its ends fixed to opposite end portions of said end panels; said pull member being so tensioned that it normally holds said vane elastically buckled into an unnatural posture in which said central portion is spaced away from said pull member, said pull member being sufficiently expansible that when heated to relax its tension said vane will be snapped toward its natural posture by its intrinsic bias, thereby bringing said pull member into face-to-face contact with said central portion.

2. A switch subassembly according to claim 1, said central portion having a crease formed therein along said longitudinal axis.

3. A switch subassembly according to claim 2, said central portion having a stress relieving opening formed therein at the center thereof.

4. A switch subassembly according to claim 1, said vane normally having a dished oblong polygonal configuration, said end panels being substantially flat and triangular and their respective end edges defining two opposite sides of the polygon, the respective outer edges of said wing panels defining the other, opposite sides of the polygon.

5. A switch subassembly according to claim 1, each of said end panels having an integral tab portion protruding from its end edge and to which an end of said pull member is affixed.

6. A switch comprising an upstanding electrically conductive support member, an upstanding electrically conductive arm having an electrical contact fixed thereon, said arm being insulated from said support member, and a switch subassembly according to claim 1 the said pull member of which has an electrical contact thereon, said vane being mounted on said support member through one of its said wing panels which is fixed to said support member in a position such that when said vane is buckled by said pull member it presses the contact on said pull member against said fixed contact and when it returns toward said natural position it moves the contact on said pull member away from said fixed contact.

* * * * *